US009030102B2

(12) United States Patent
Foti

(10) Patent No.: US 9,030,102 B2
(45) Date of Patent: May 12, 2015

(54) LED LIGHTING DEVICES HAVING A CONTROL SYSTEM OPERATIVE IN MULTIPLE MODES

(75) Inventor: Ivan Foti, Richmond (GB)

(73) Assignee: Maxgreen LED Limited, Tortola (VG)

( * ) Notice: Subject to any disclaimer, the term of this patent is extended or adjusted under 35 U.S.C. 154(b) by 39 days.

(21) Appl. No.: 13/700,117

(22) PCT Filed: May 9, 2011

(86) PCT No.: PCT/EP2011/057414

§ 371 (c)(1),
(2), (4) Date: Mar. 4, 2013

(87) PCT Pub. No.: WO2011/141420

PCT Pub. Date: Nov. 17, 2011

(65) Prior Publication Data

US 2013/0200810 A1 Aug. 8, 2013

(30) Foreign Application Priority Data

May 10, 2010 (GB) ..... 1007727.9

(51) Int. Cl.
*H05B 37/02* (2006.01)
*H05B 33/08* (2006.01)

(52) U.S. Cl.
CPC ..... *H05B 33/0854* (2013.01); *H05B 37/0263* (2013.01)

(58) Field of Classification Search
CPC ..... H05B 37/02; H05B 33/08
USPC ..... 315/149, 150, 152, 153, 154, 155, 157, 315/159, 291, 308, 360; 307/116, 117
See application file for complete search history.

(56) References Cited

U.S. PATENT DOCUMENTS

| | | | | |
|---|---|---|---|---|
| 5,227,762 | A | 7/1993 | Guidette et al. | |
| 6,583,719 | B2 * | 6/2003 | Okada et al. | 700/17 |
| 8,253,353 | B2 * | 8/2012 | Baggen et al. | 315/308 |
| 8,400,061 | B2 * | 3/2013 | Kuang et al. | 315/77 |
| 8,575,846 | B2 * | 11/2013 | Delnoij | 315/152 |
| 8,664,864 | B2 * | 3/2014 | Salsbury | 315/152 |
| 2002/0065583 | A1 | 5/2002 | Okada et al. | |
| 2003/0222603 | A1 | 12/2003 | Mogilner et al. | |

(Continued)

FOREIGN PATENT DOCUMENTS

| | | |
|---|---|---|
| EP | 223998 | 6/1987 |
| GB | 2 229 023 | 9/1990 |

(Continued)

OTHER PUBLICATIONS

EU Search Report in related application No. GB1007727.9 mailed Jan. 21, 2011.

*Primary Examiner* — Thuy Vinh Tran
(74) *Attorney, Agent, or Firm* — Maschoff Brennan

(57) ABSTRACT

A lighting device includes an LED light source (20) operable by electric power supplied to the device, and a control system (23) receiving electric power from an external power supply (26) and supplying power to the light source (20). The control system (23) also being operable of operating in a second mode to supply power to the light source (20) only on receipt by the control system (23) via the power supply (26) of a signal identifying said device. Thus the device (24) can be incorporated in a conventional lighting circuit or a circuit in which the devices (24) are individually controlled.

16 Claims, 3 Drawing Sheets

(56) References Cited

U.S. PATENT DOCUMENTS

| | | | |
|---|---|---|---|
| 2004/0207341 | A1 | 10/2004 | Callahan |
| 2004/0225811 | A1 | 11/2004 | Fosler |
| 2006/0284734 | A1 | 12/2006 | Newman, Jr. |
| 2008/0030299 | A1 | 2/2008 | Beck |
| 2008/0088258 | A1 | 4/2008 | Ng |
| 2008/0203928 | A1 | 8/2008 | Frumau et al. |
| 2009/0128056 | A1 | 5/2009 | Lin |
| 2009/0171510 | A1 | 7/2009 | Hu |
| 2009/0273433 | A1 | 11/2009 | Rigatti et al. |
| 2010/0079083 | A1 | 4/2010 | Seguine |
| 2010/0283401 | A1 | 11/2010 | Chung et al. |

FOREIGN PATENT DOCUMENTS

| | | |
|---|---|---|
| WO | 92/16086 | 9/1992 |
| WO | WO 02/13490 | 2/2002 |
| WO | WO 2008/130840 | 10/2008 |
| WO | 2009/156602 | 12/2009 |

* cited by examiner

LED LIGHTING DEVICES HAVING A CONTROL SYSTEM OPERATIVE IN MULTIPLE MODES

The invention relates to LED lighting device and to methods of controlling such devices.

A conventional LED lighting device may, for example, be turned on and off by means of an external switch that controls the supply of electrical power to the bulb so that the switch is used to make or break the electrical circuit supplying power to the bulb. An external switch can also be used to vary the amount of power delivered to the bulb, in order to dim it for example.

US 2010/0079083 discloses an LED lighting unit that includes an address or ID that can be accessed from a control system. The control system allows a particular unit to be selected via a touch pad and an icon and a control system to be transmitted to the unit via a control module, a coupling circuit, the power lines and a second coupling circuit associated with the lighting unit. It is a problem with such an arrangement that the LED lighting unit can only be controlled using an addressed signal.

According to a first aspect of the invention, there is provided a lighting device including an LED light source operable by a an electric power supplied to the device, and a control system receiving electric power from an external source and supplying power to the light source, the control system also being operable to supply power to the light source only on receipt by the control system via the power supply of a signal identifying said device.

In this way, the LED device can be used in a conventional lighting circuit but can also be used under the control of an external control circuit that controls selectively a number of such LED devices.

Figure 1:
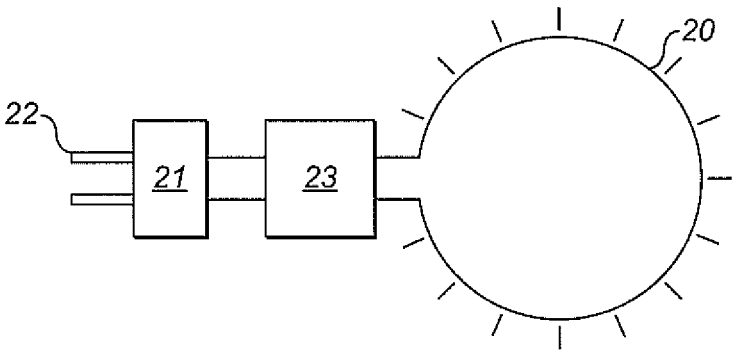
Figure 2:
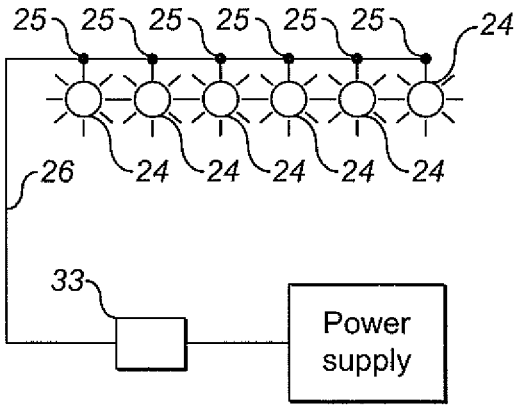
Figure 3:
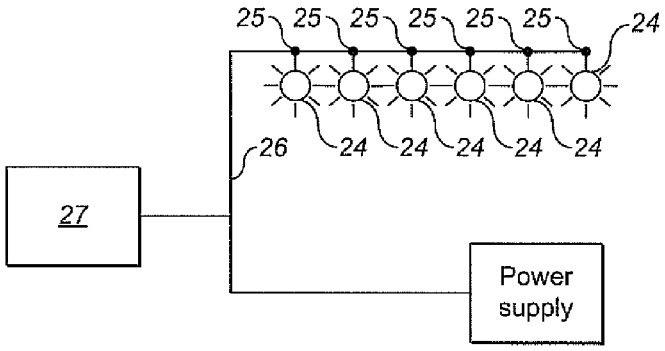
Figure 4:
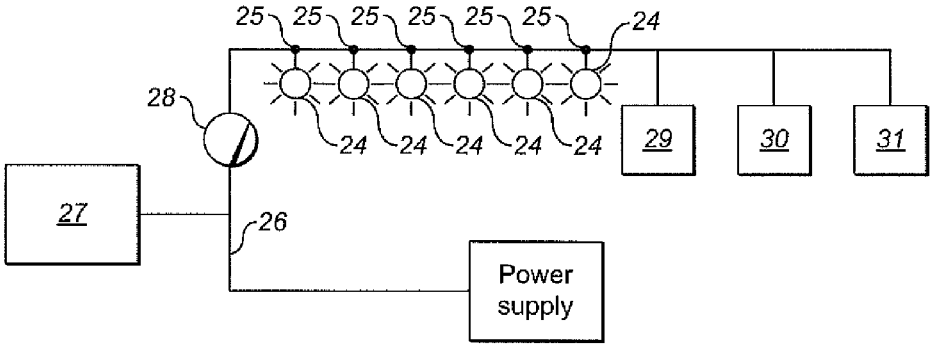
Figure 5:
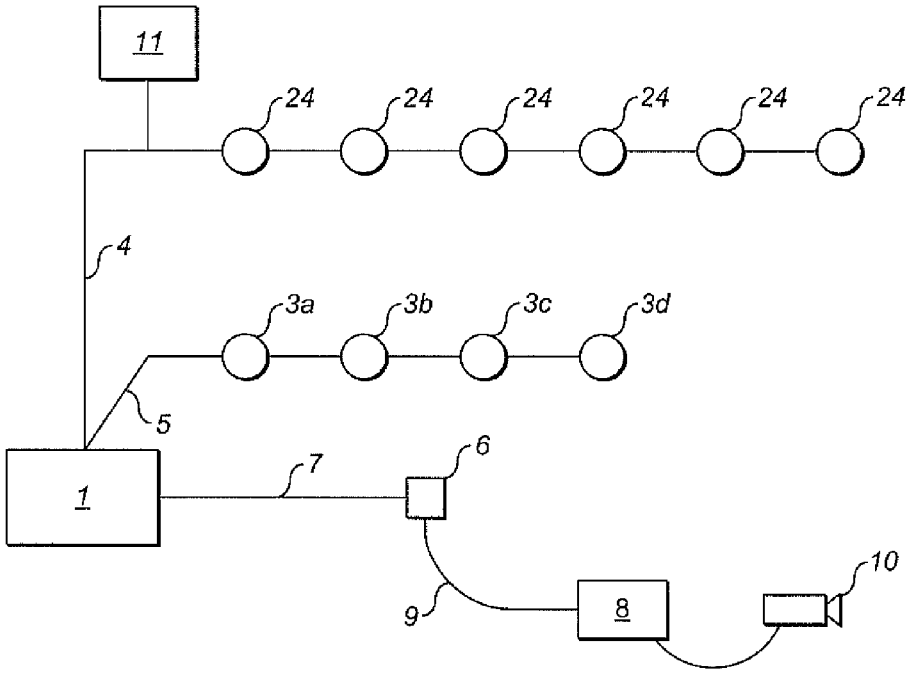

The following is a more detailed description of some embodiments of the invention, by way of example, reference being made to the accompanying drawings, in which:

FIG. 1 is a schematic view of an LED lighting device,

FIG. 2 is a schematic view of a lighting circuit incorporation a number of LED lighting devices of the kind shown in FIG. 1 and controlled by a switch, FIG. 3 is a schematic view of a lighting circuit incorporation a number of LED lighting devices of the kind shown in FIG. 1 and controlled by a controller, FIG. 4 is a similar view to FIG. 3 but with the incorporation of a switch, and FIG. 5 is a schematic view of a further embodiment of the invention.

Referring first to FIG. 1, the lighting device comprises an LED light source 20. The device also includes a fitting 21 for connecting the source 20 to a lighting power circuit and the fitting 21 includes a connector 22 that co-operates with a complimentary connector in the circuit to mount the device. Such connectors are known and will not be described in detail.

The device includes a control system 23 that is electrically connected between the light source 20 and the fitting 21. The control system 23 is preferably embodied as a programmed microprocessor. The control system 23 acts in two modes. In a first mode it acts it is transparent and power supplied to the fitting is passed to the LED light source 20.

In a second mode it acts as a switch between the fitting 21 and the light source 20 to control the supply of electrical power to the light source 20. This is achieved in the following way. The control system 23 stores a code that identifies the lighting device uniquely and, on receipt by the device—in a manner to be described below—of a correspondingly coded signal, the control system 23 allows electric power to pass to the light source 20 to cause the source 20 to emit light.

Referring next to FIG. 2, a lighting circuit includes a number of lighting devices 24 of the kind shown in FIG. 1—in FIG. 2 there are six such devices 24. The circuit also includes six holders 25 that receive the fittings 21, 22 of the associated device 24 to connect the devices 24 in series to a power supply line 26. The connection in series is optional—the devices 24 could be connected with the power lines in any convenient way. The lighting circuit is a conventional circuit that operates under the control of a manual switch 33 so that operating of the switch 33 causes power to be supplied to the devices 20 with the control systems 23 of the control systems 23 acting in transparent mode.

Referring next to FIG. 3, the switch 33 may be replaced by a controller 27 that may, for example, include a personal computer. The controller 27 generates and passes to the power line 26 one or more identifier signals each identifying uniquely a lighting device 24 or devices 24 that are required to be activated. Where the controller includes a PC, this may be done by a programme run on PC either with or without intervention through an input device. This is described in more detail below.

When an identifier signal corresponding to a particular lighting device 24 is received at the device through the power line 26, it is detected by the control system 23 so causing the control system 23 to allow electrical power to pass from the fitting 21 to the light source 20 to illuminate the light source 20. It will be appreciated that, in the embodiment shown in FIG. 2, the controller 27 could generate any required combination of identifier signals to provide any required lighting pattern. This might be required if, for example, the lighting devices are in different rooms. There might be different lighting patterns required at different times of the day or night. Again, some examples of this are described below. In addition, of course, the power circuit is far less complicated, and so far more reliable, than conventional power circuits that require switching wires. There are also significant cost benefits in both labour and materials.

In the embodiment described above with reference to FIG. 3, the controller 27 would need to be programmed with the identities of the lighting devices 24 in the circuit. This is not essential and it is preferred that the control system 23 in each device 24 transmits through the lighting circuit an identifying signal that is received by the controller 27, stored by the controller 27 and used by the controller 27 to identify the lighting devices 24 in the circuit controlled by the controller 27. This can be used to allow identification of faulty devices 24 and also ensures that, when a faulty device 24 is replaced, the new device identifies itself to the controller 27.

An arrangement of the kind shown in FIG. 3 can be used to control one or more manually operated switches in a light circuit, as seen in FIG. 4. Parts common to this Figure and FIGS. 1 and 3 are given the same reference numerals.

Referring to FIG. 4, the lighting circuit contains a switch 28. The controller 27 can be used to cause operation of the switch 28 to result in illumination of any required combination of lighting devices 24. This is done by including in the switch 28 a code generator that passes to the power circuit a signal identifying the switch 28. This is detected by the controller 27 and, when the switch 28 is switched "on", the controller 27 generates identifier signals for those lighting devices 24 that it is desired to illuminate when the switch 28 is operated. The switch 28 can, of course, be programmed to control any desired combination of devices 24 and this can be useful when, for example, partitions are moved.

It will be appreciated that a lighting circuit could include two or more switches 28 that can be controlled as described above with reference to FIG. 4 to provide any required lighting pattern.

The control system 23 of each lighting device 24 may perform other functions in conjunction with the controller 27. Where the control system 23 is a microprocessor, this may be achieved by programming the microprocessor. For example, the control system 23 might control the quantity of power supplied to the light source 20 in accordance with a signal generated by the controller 27 to allow the light source 20 to be dimmed.

The operation of the lighting devices 24 need no be solely under the control of the controller 27 and/or any switch 28, where provided. Other devices may be used for such control. For example, a smoke alarm 29 or a burglar alarm 30 may be incorporated into the power circuit 26 and produce identifier signals that allow the comptroller 27 to activate selected lighting devices 24 when the smoke alarm 29 and/or the burglar alarm 30 operates. Additionally or alternatively, the circuit could incorporate an ambient brightness detector 31 that passes a signal to the controller 27 that allows the controller 27 to adjust the brightness of the lighting devices 24 in accordance with the detected brightness, so saving power.

In all the embodiments described above with reference to the drawings, the controller 27 and the lighting devices 24, and the smoke alarm 29, the burglar alarm 30 and the ambient brightness detector 31, where provided, communicate via the lighting power circuit.

In this way, an LED lighting device is provided that can be used in a conventional lighting circuit but that allows the circuit to be adapted to for separate control of the devices 20.

A further embodiment of the invention is shown in FIG. 4. A distribution board 1 is coupled to a first array of six LED devices 24 via a first circuit 4, and a second array of four sensors 3*a*-3*d* via a second circuit 5. A power circuit 7 also couples a socket 6 to the distribution board 1.

Each of the LED devices 24 is of the kind described above with reference to FIG. 1 and inserted into a connector. There are no switches associated with the circuit 5 to control the operation of the LED light devices 24.

Each of the sensors 3*a*-3*d* may be any of an ambient light sensor, a passive infra-red detector or a Doppler radar detector. The particular function of each is described below.

Each device 24 and each sensor 3*a*-3*d* has a preset address, which is unique to that device or sensor, as described above. Thus, each device 24 and each sensor 3*a*-3*d* may be individually and uniquely addressed by a controller 11 coupled to the circuit 4. The circuit 4 is electrically coupled to the circuit 5 and the power circuit 7 via the distribution board, and thus, signals from controller 11 can reach the sensors 3*a*-3*d* on the circuit 5.

The controller 11 is capable of constructing data packets comprising an address portion and a command portion and then generating a command signal which it superimposes on the circuit 4. It can also receive signals generated by the devices 24 and the sensors 3*a*-3*d* and reconstitute data packets from them.

Each device 24 comprises a control system 23, as described above, which can be caused to open or close so as to couple or decouple the LED device 24 from the circuit 4, thereby turning it on or off. The operation of this control system 23 is controlled by the controller 11 by generating a data packet having an address portion comprising the address of the device and a command portion comprising a command which causes the device to turn on or off as required. A command signal is then generated from the data packet and the command signal is superimposed on the circuit 4 by the controller 11. The signal is then received by each of the devices 24 and the sensors 3*a*-3*d*, but only the device with a control system 23 containing the address in the address portion of the data packet will respond to the command by turning the device on or off.

In a variant of the devices 24, a power regulator is provided to control the amount of power that is supplied from the circuit 4 to the attached LED device. The power regulator may be provided in the control device of each LED device 24. The power regulator is responsive to the command portion of a data packet as described in the preceding paragraph, although in this case the command portion comprises a different command code which causes the power regulator to adjust the power accordingly. Different command codes may be used to increment or decrement the power supplied, to set the power supplied to a preset value or to a value specified in the command portion.

In another variant, the devices 24 may comprise an ambient light sensor and each control device 23 may receive a command code instructing it to adjust the power supplied to the LED device 24 so that a desired amount of light is provided in the vicinity of the device 24. Thus, the amount of power supplied can be adjusted by the device 24 so that the ambient light is at the desired level. This allows the amount of power supplied to be reduced during daylight hours, thereby helping to reduce energy consumption.

In addition, the LED devices 24 can be adapted to measure the power and/or voltage being supplied to the device, and the time for which power has been supplied. It may also be able to detect whether a fault (such as an open or short circuit on the LED device) has occurred. Any of these parameters may be reported to the controller 11 on receipt of an appropriate command code in a data packet addressed to one of the devices 24. The control system 23 of each LED device 24 responds by constructing a response data packet comprising details of the measured parameter or the fault condition. In the case of a fault, the device 24 may simply construct a data packet for transmission to the controller over circuit 4 without receiving a command code.

As will become apparent below, the controller 11 may have access to a database is which includes the location of each of the LED devices 24. This allows the controller 11 to respond to the detection of a fault by sending a message, such as an e-mail or SMS, to an operator to alert the operator to the fault and to the exact location. This is especially useful in larger installations. Furthermore, the system can monitor the power drawn by the LED devices 24 and predict when they will need replacement. This is possible because LEDs have a fairly well-defined degradation profile and the system can be programmed to alert the operator when the power has fallen to a predefined value (for example, which relates to the point at which only half the original light output is being achieved), which indicates that the LED device 24 should be replaced.

The sensors 3*a*-3*d* are also responsive to the command portion of a data packet in the same manner as described above. However, when one of the sensors 3*a*-3*d* receives a command code from a data packet comprising its unique address, it responds by constructing a response data packet comprising a sampled value of an ambient condition monitored by the sensor and to superimpose a signal representing the response data packet onto the power source. This signal is then received by the controller 11 which can process the sampled value appropriately.

As mentioned above, each of the sensors 3*a*-3*d* may be any of an ambient light sensor (typically comprising a photocell or photodiode as the active element), a passive infra-red (PIR) sensor, or a Doppler radar detector. Each has different uses.

The ambient light sensor detects the level of ambient light in a zone or region. The sampled ambient light levels received by the controller 11 from one of this type of sensor can be used to adjust the power supplied by the devices 24 in the same zone or region so that a desired light level is achieved overall.

The PIR detector detects movement in a zone or region. The controller 11 can poll this type of sensor and when movement is detected it can turn on the devices 24 in the region.

The Doppler radar detector also detects movement in a zone or region, but it can also detect the direction of motion. This can be used by the controller 11 to pre-empt where an individual is heading and to control the devices 24 in the same zone or region or in adjacent zones or regions (such as a room entered via a corridor that the individual is walking down) so that they turn on before the individual has reached those devices.

Other types of interaction are possible between different types of sensor and device. For example, a smoke detector may be coupled to the system and the controller 11 cause to activate emergency lighting devices if smoke is detected by the smoke detector.

In order to set up the automatic lighting system a laptop 8 is plugged via an adaptor 9 into the socket 6. The adaptor 9 allows digital data from the laptop 8 to be coupled to the mains power supply as analogue signals representing the digital data. Typically, it will be serial digital data transmitted via a USB port. The laptop is also coupled to a camera 10.

Firstly, the laptop 8 causes a broadcast signal to be superimposed onto circuit 7, which is coupled to circuits 4 and 5 via the distribution board 1. The broadcast signal is generated by the adaptor 9 from a broadcast data packet sent by laptop 8. The broadcast data packet comprises an address portion with a broadcast address. All of the devices 24 and sensors 3*a*-3*d* are programmed to respond to the broadcast address. Each does this by transmitting response data packets indicating its address and the functions it can perform. Thus, the laptop 8 is able to detect every device 24 and sensor 3*a*-3*d* coupled to circuits 4 and 5. In order to prevent collision of data, each device 24 and sensor 3*a*-3*d* sends its response data packet at a time offset which depends on its address. Thus, each response data packet is sent in a different time interval.

Each device 24 and sensor 3*a*-3*d* is programmed to issue a response data packet periodically if it has not received a broadcast data packet since being powered up. This ensures that devices are not "orphaned" if they do not receive a broadcast data packet for some reason.

The laptop 8 then compiles a database which includes a row for each detected device 24 and sensor 3*a*-3*d*. Each row indicates the device's or sensor's address and the functions it can perform. This database is then supplied to the controller 11 so that it can send suitable commands as explained above to control the devices 24 and receive sampled sensor values from the sensors 3*a*-3*d*.

The laptop 8 then transmits a command to each of the devices 24 in turn to cause it to switch on the connected LED device 24 and then to switch it off again. The illumination provided by each of the LED devices is detected by the camera 10 and the image data from this is analysed by software on the laptop 8 to determine the position of the device 24 that has just been switched on and off again. This position can be refined either by manual adjustment or by correlation with a CAD model of the lighting layout which indicates where lights have been installed. Thus, the software on the laptop 8 is able to determine the location of each device 24 and its address with no previous knowledge of these simply by switching the devices 24 detected in the preceding step on and off.

The database can then be updated so that each row indicates the location (for example, a zone or region) in which each of the devices 24 is located. If the controller 11 is also aware of the location of each sensor 3*a*-3*d* it is able to use these to detect the presence of an individual (and potentially their direction of motion as explained above) and control the devices 24 appropriately to provide lighting.

For example, in a practical scenario three of the devices 24 of FIG. 5 could be present in a corridor along with PIR sensor 3*a* and each of three rooms could contain one each of the remaining devices 24 and PIR sensors 3*b*-3*d*. Clearly, it is desired that the corridor devices 24 should be activated when PIR sensor 3*a* detects movement and each of the room devices 24 should be activated when a respective one of PIR sensors 3*b*-3*d* detects movement. However, it is not necessary for the electrician installing the system to have any knowledge of this when he lays the cable. All that is necessary is that he connects the devices 24 and sensors 3*b*-3*d* to a circuit cable which is coupled to the controller 11. The set-up process described above allows the presence and location of the devices 24 to be determined and associated with the sensors 3*a*-3*d* for automatic control.

The controller 11 may also run web server software to allow for remote monitoring and reporting over a conventional IP network. For example, it may provide the capability to report on detected fault conditions via a web page or it may provide reports on power consumption figures. This last feature could allow the effects of different lighting algorithms (for example, to adjust the power supplied to the LED devices 24 depending on the amount of detected daylight) on the overall power consumption to be monitored, which may help to reduce energy consumption without a particularly deleterious effect on the lighting level.

It will this be seen that the LED devices 24 described above with reference to the drawings can work in any existing fitting even with a conventional switch in place.

In addition, the devices 24 are individually addressable, so in an application where there are many devices but only one switch it now becomes possible to control each bulb independently even though there is only one switch.

Each device 24 preferably has a built is microprocessor which can send a receive signals through the power wires to a receiver/transmitter connected to the same circuit. Each device is individually coded so as to be identified by the controller.

The LED device described above with reference to the drawings reduces significantly the need for wires and wiring need to control lights. In the case of a new building no switching wires are needed for any of the lighting when using the LED device. This will have a considerable impact on the costs of labour and materials.

The LED device allows switches to control lighting to be placed anywhere in a house or building giving much more flexibility on terms of design and alteration.

The LED devices described above with reference to the drawings can also communicate with other bulbs in the same circuit and more complex functions can be derived from this added functionality. Device control can be linked to external sensors such as ambient light detectors and the brightness adjusted automatically according to conditions. Once again this can be achieved with no extra wiring to an existing circuit.

There are implications for safety as with fewer wires and connections there is less possibility of a wiring fault being introduced to a circuit with the addition of control wires.

The invention claimed is:

1. A lighting device including:

an LED light source operable by electric power supplied to the lighting device;

a control system; and a connector configured to connect the lighting device to an external power supply, the control system being operable in at least two modes, in a first mode the control system being transparent so that power supplied to the connector is passed by the control system to the light source, and in a second mode the control system supplying power from the connector to the LED light source only on receipt by the control system via the power supply of a signal identifying said lighting device.

2. A device according to claim 1 wherein, on receipt of said signal identifying the lighting device, the control system acts as a switch to control the supply of electrical power to the LED light source.

3. A device according to claim 1 wherein said signal identifying the lighting device includes information identifying the amount of power to be supplied to the LED light source and hence the brightness of the LED light source, the control system, on receipt of said signal, allowing said amount of power to pass to the LED light source.

4. A device according to claim 1 in combination with a sensor, the sensor, on operation, producing a sensor signal received by the control system, the control system passing power to the LED light source on receipt of the sensor signal.

5. A device according to claim 4 wherein the sensor is one of: an ambient light sensor, a passive infra-red detector, a Doppler radar detector, a smoke alarm, a burglar alarm.

6. A device according to claim 1 wherein the control system is a microprocessor.

7. A device according to claim 1 wherein the control system produces an identifier signal identifying the lighting device and for use in the generation of said signal identifying the lighting device.

8. A device according to claim 1 wherein the connector releasably connects the lighting device to a co-operating connector in a lighting circuit.

9. A device according to claim 1 in a lighting circuit together with a controller, the controller generating said signal identifying the lighting device.

10. A device according to claim 9 wherein said signal identifying the lighting device is a digital signal.

11. A device according to claim 10 wherein, on receipt of said signal identifying the lighting device, the control system acts as a switch to control the supply of electrical power to the LED light source and wherein said signal identifying the lighting device is in the form of a packet, a first part of the packet identifying the lighting device and a second part of the packet controlling the control system.

12. A device according to claim 9 wherein the controller is programmable to produce said signal identifying the lighting device at a predetermined time.

13. A device according to claim 9 wherein said lighting device is one of a plurality of lighting devices in said lighting circuit, the controller controlling all the lighting devices in said lighting circuit.

14. A device according to claim 13 wherein the controller is programmable to generate control signals for a selected number of said plurality of lighting devices on receipt of an input signal thereto.

15. A device according to claim 14 wherein the input signal is generated by manual operation of a switch connected to the controller.

16. A device according to claim 13 wherein the controller is programmable to generate control signals for a first selected number of said lighting devices on receipt of a first input signal thereto and to generate control signals for a second selected number of said lighting devices on receipt of a second input signal thereto, the first and second input signals being generated by respective switches.

* * * * *